US005185927A

United States Patent [19]

Rivers

[11] Patent Number: 5,185,927

[45] Date of Patent: Feb. 16, 1993

[54] SEGMENTED GUARD BAR WITH IMPROVED SKIN FLOW CONTROL

[75] Inventor: David F. Rivers, Wallingford, Conn.

[73] Assignee: Warner-Lambert Company, Morris Plains, N.J.

[21] Appl. No.: 699,066

[22] Filed: May 13, 1991

[51] Int. Cl.[5] ..... B26B 21/14

[52] U.S. Cl. ..... 30/50; 30/77; 30/81

[58] Field of Search ..... 30/50, 77, 74.1, 81, 30/83, 49, 51, 59, 61, 63, 65, 73, 79

[56] References Cited

U.S. PATENT DOCUMENTS

| | | | |
|---|---|---|---|
| 4,069,580 | 1/1978 | Cartwright et al. | 30/47 |
| 4,146,958 | 4/1979 | Chen et al. | 30/50 |
| 4,409,735 | 10/1983 | Cartwright et al. | 30/77 |
| 4,443,939 | 4/1984 | Motta et al. | 30/81 |
| 4,516,320 | 5/1985 | Peleckis | 30/49 |
| 4,641,429 | 2/1987 | Abatemarco | 30/50 |
| 4,720,917 | 1/1988 | Solow | 30/49 |
| 4,754,548 | 5/1988 | Solow | 30/50 |
| 4,854,043 | 8/1989 | Chen | 30/50 |
| 4,976,028 | 12/1990 | Chen | 30/49 |
| 5,003,694 | 4/1991 | Chen | 30/49 |
| 5,060,377 | 10/1991 | Althaus et al. | 30/50 |

FOREIGN PATENT DOCUMENTS

0300478A2 1/1989 European Pat. Off. .

*Primary Examiner*—Douglas D. Watts
*Assistant Examiner*—Hwei-Siu Payer
*Attorney, Agent, or Firm*—Richard S. Bullitt

[57] ABSTRACT

A segmented guard bar and skin flow control members disposed in the spaces between the guard bar segments. Though not limited to any specific type of razor, the present invention is particularly suited for use with a flexible safety razor having a cap member at least one and preferably two blades separated by a spacer, and a blade seat having a plurality of blade support portions separated by corrugations and a segmented guard bar with each segment independently connected to the blade support portions.

12 Claims, 6 Drawing Sheets

SEGMENTED GUARD BAR WITH IMPROVED SKIN FLOW CONTROL

The present invention is directed to a guard bar for a safety razor and, more particularly, to a guard bar comprising a plurality of segments and improvements for skin flow control in the spaces between the segments.

BACKGROUND OF THE INVENTION

In recognition of the fact that surfaces being shaved are not perfectly planar, a razor head comprising a cap, two blades separated by a spacer, and a guard bar have been designed such that the entire razor head flexes as a unit during shaving. In order to maximize the flexibility of the blade seat, one design includes a guard bar formed of a plurality of discrete segments. These segments are independently supported by the blade seat. Adjacent segments of the guard bar are thus separated by spaces. This segmented guard bar design has proven very successful in providing overall flexibility to the razor head without noticeable distortions to the blade geometry during shaving.

The consistent achievement of a close, comfortable shave depends upon careful control of the blade geometry. To this end, the present invention is directed to further improvements in razor heads utilizing segmented guard bars.

Those skilled in the art appreciate that a guard bar, which is designed to be the first element of a safety razor to contact a given area during a shaving stroke, affects the manner in which the skin approaches the edge of the seat blade. During a shaving stroke, skin typically flows over a guard bar and into the space between the guard bar and seat blade some distance below a tangent drawn from the top of the guard bar to the blade edge. The degree to which skin may flow below such a tangent line depends upon the seat blade span, i.e. the distance between the guard bar and seat blade edge.

Though the spaces between segments of a segmented guard bar have been designed to minimize the amount of skin which is not actually contacted by the guard bar segments during a shaving stroke, variations in the skin flow may still result. The skin flowing through the spaces between the segments may contact the seat blade edge at a different angle than the skin flowing over the guard bar segments. Additionally, when a flexible razor head having a segmented guard bar flexes in response to forces encountered during shaving, the space between at least some of the segments increases. This space increase further increases the possibility of a non-uniform skin flow immediately forward of the seat blade. A non-uniform skin flow may adversely affect the comfort of the shave.

It would therefore be desirable to provide greater skin flow control to a segmented guard bar to further minimize and preferably eliminate potential variations in skin flow over a segmented guard bar and thereby provide better control of the blade geometry during shaving.

SUMMARY OF THE INVENTION

The present invention is directed to a segmented guard bar comprising skin flow control members disposed in at least one of the spaces between the guard bar segments. Though not limited to any specific type of razor, the present invention is particularly suited for use with a flexible razor head having a cap member, at least one and preferably two blades separated by a spacer, a blade seat having a plurality of blade support portions separated by corrugations, and a segmented guard bar with each segment independently connected to the blade support portions.

DETAILED DESCRIPTION

For purposes of illustration, the present invention has been illustrated and will be described herein in conjunction with a flexible razor head. As used herein, the term "razor head" is meant to include both razor cartridges adapted to be utilized with a separate handle, as well as the upper, operative elements of a disposable razor to which a handle is permanently attached. For ease of explanation, the present invention is described herein as a disposable cartridge adapted for attachment to a separate razor.

Figure 1:
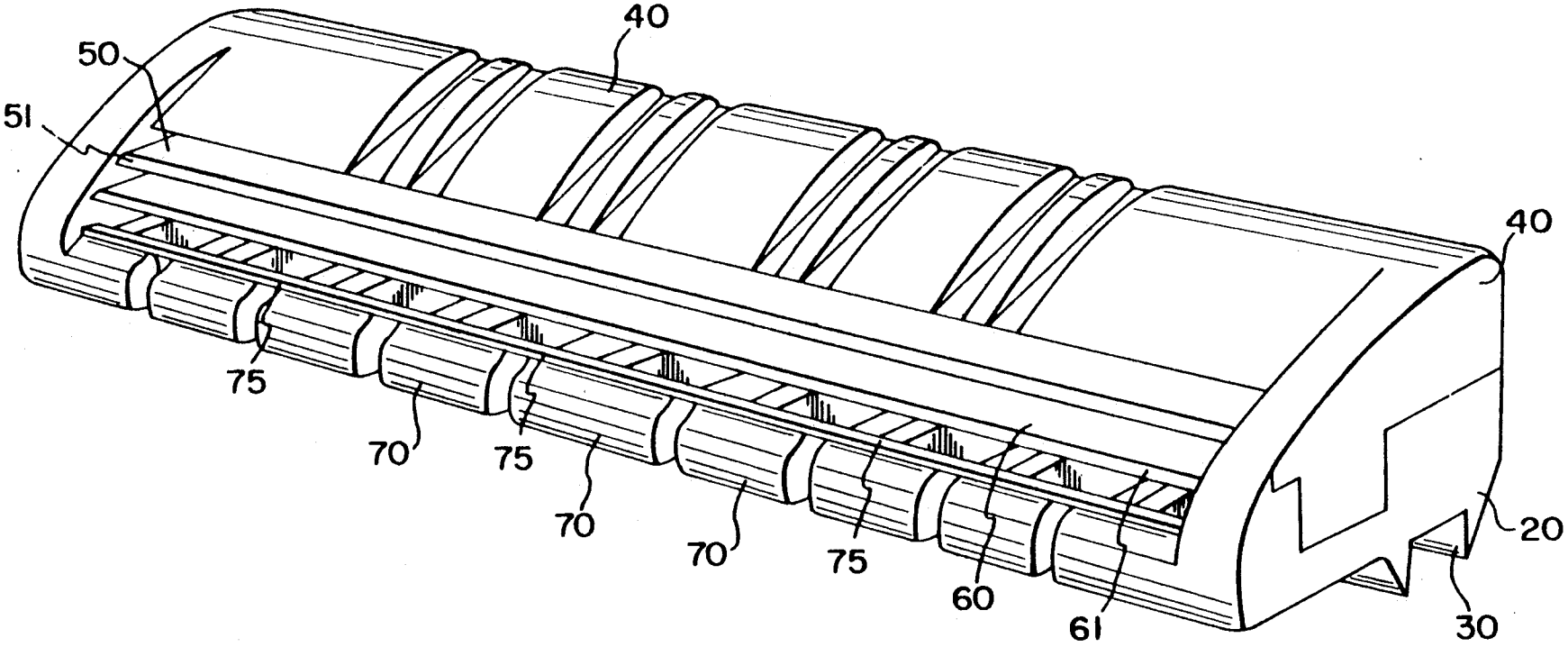
FIG. 1 is a perspective view of a razor head of one embodiment of the present invention.

FIG. 1 illustrates a razor head of one embodiment of the present invention having a blade seat 20, attachment members 30, a cap member 40, a cap blade 50 having sharpened edge 51, a seat blade 60 having sharpened edge 61, and a guard bar comprising a plurality of segments 70. The manner of connecting the various elements may be with the use of pins as disclosed in U.S. Pat. No. 4,854,043 to Chen, which is hereby incorporated by reference. Other methods are also suitable without departing from the scope of the present invention. For example, the cap, blade support, blade spacer, and segmented guard bar may also be integrally formed around one or more blades by an insert molding process.

Figure 2:
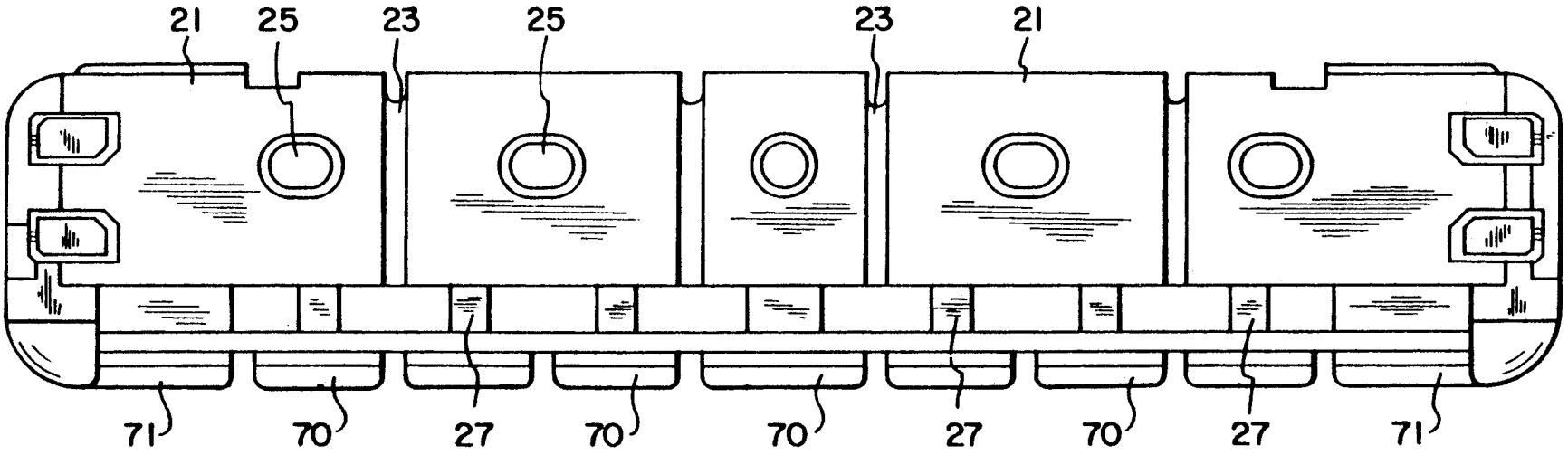
FIG. 2 is a top view of a blade seat of one embodiment of the present invention.
Figure 3:
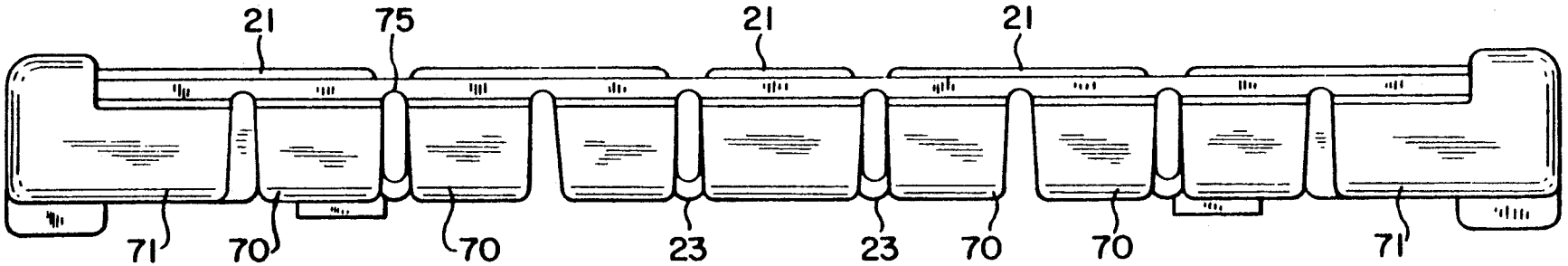
FIG. 3 is a front view of the blade seat shown in FIG. 2.
Figure 4:
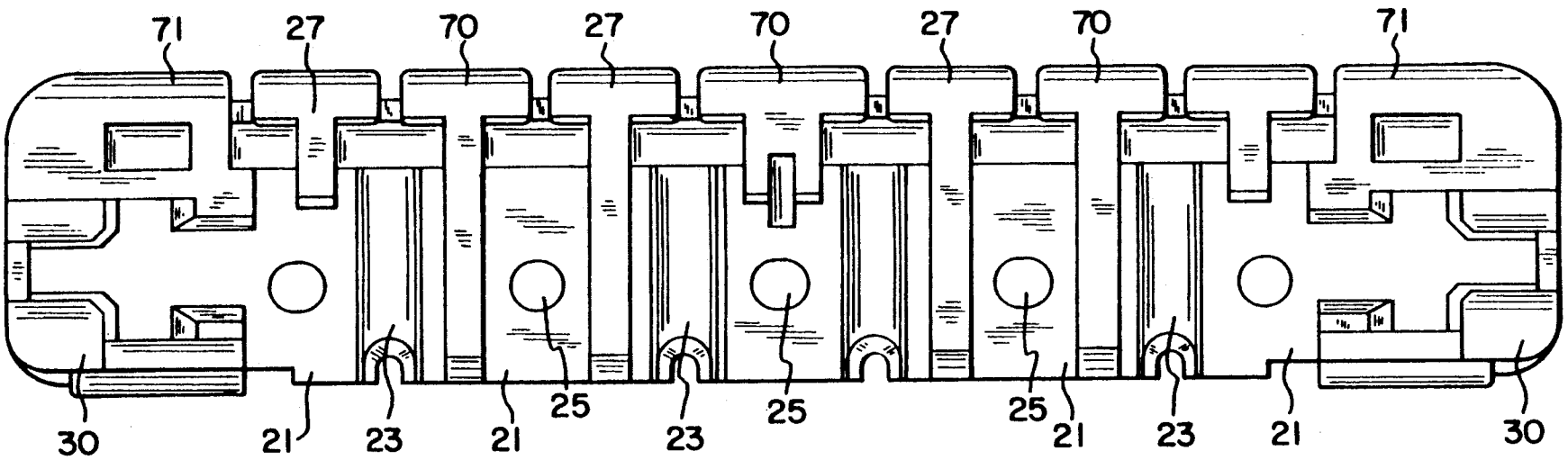
FIG. 4 is a bottom view of the blade seat shown in FIG. 2.

The present invention provides greater skin flow control than previously disclosed segmented guard bars by increasing the control of skin through the space between adjacent segments. The skin flow control members of one illustrated embodiment are best understood with reference to FIGS. 2–4. As illustrated, blade seat 20 is integrally formed with a plurality of blade supports 21 separated by corrugations 23 and having holes 25 adapted to receive locking pins of cap member 40. The guard bar segments 70 are individually supported by blade supports 21 via connectors 27, with the exception of end segments 71 which are integrally formed with the sidewalls of blade seat 20 and attachment members 30

Figure 5:
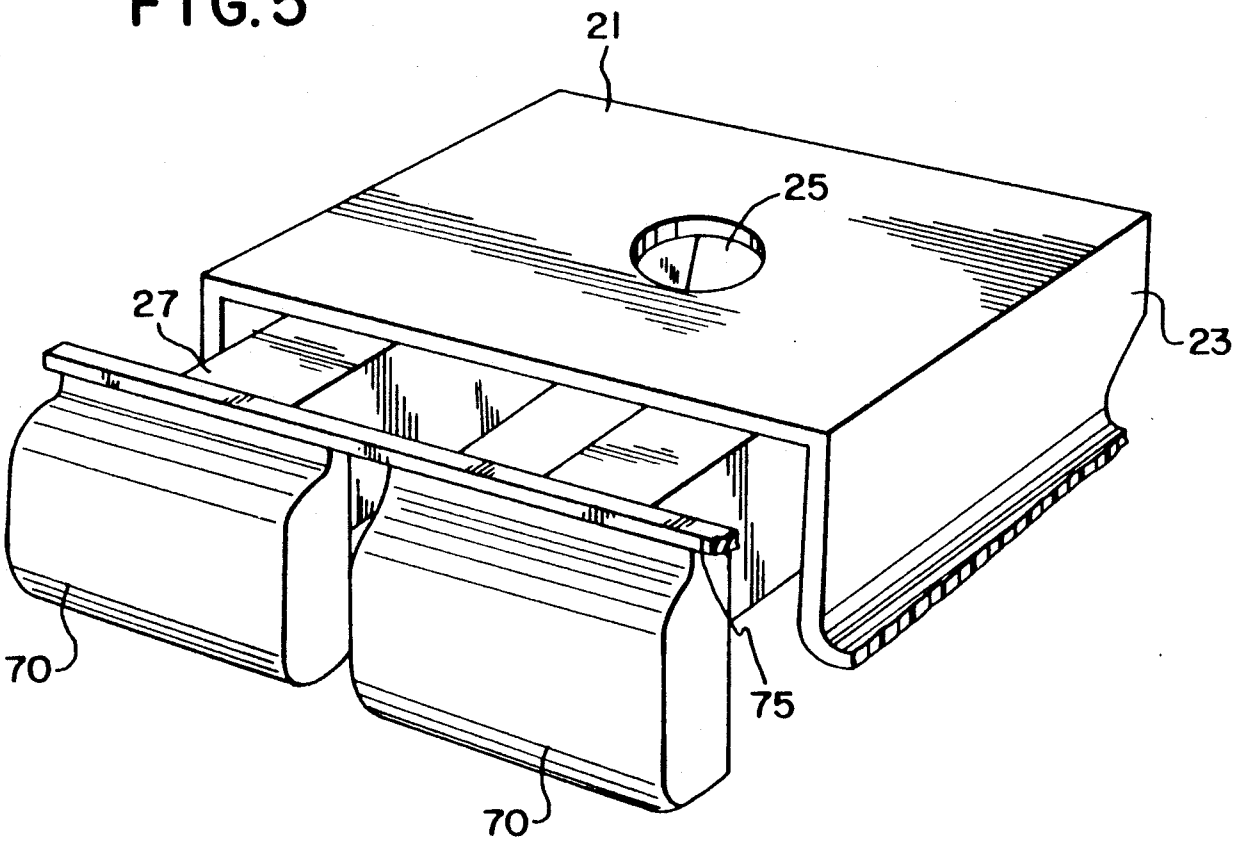
FIG. 5 is an enlarged view of the skin flow control member disposed between two segments of a guard bar of one embodiment of the present invention.

In the embodiment illustrated in FIGS. 5, skin flow control members 75 comprise relatively thin webs of thermoplastic material which join adjacent guard bar segments. Skin flow control members 75 are preferably disposed in the upper rearward regions of the spaces between the individual guard bar segment 70 in order to guide the skin flow in a fashion similar to the segments 70. The skin flow control members 75 of this embodiment of the present invention direct the flow of skin uniformly over the length of the segmented guard bar. In this embodiment of the present invention the web 75 has substantially fixed length.

Figure 7:
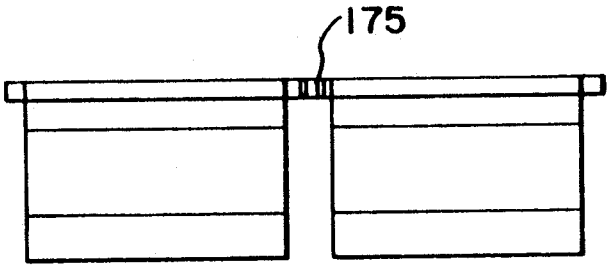
FIGS. 6 and 7 are top and front enlarged views, respectively, of another embodiment of the present invention.
Figure 6:
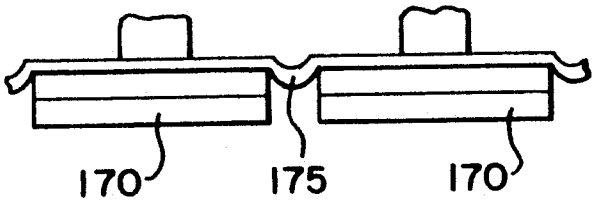

According to alternative embodiments of the present invention, the skin flow control members are designed to modify the otherwise unobstructed flow of skin through the spaces while permitting adjacent guard bar segments 170 to move more closer and/or further apart. In the illustrated embodiment of FIGS. 6 and 7, skin flow control members 175 are formed in a manner similar to corrugations 25 referenced above. Each skin flow control member 175 is disposed between guard bar segments 170 such that the base of the corrugation faces forwardly. According to this embodiment of the present invention, skin flow control member 175 prevents skin from flowing unobstructedly through the space between adjacent guard bar segments 170 while still permitting the space between the guard bar segments 170 to increase or decrease when the razor head is flexed during shaving.

Figure 9:
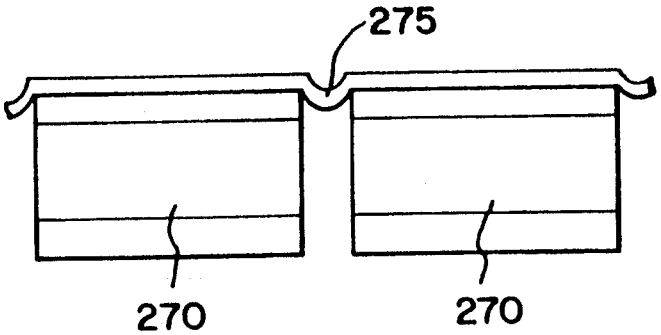
FIGS. 8 and 9 are top and front enlarged views, respectively, of still another embodiment of the present invention.
Figure 8:
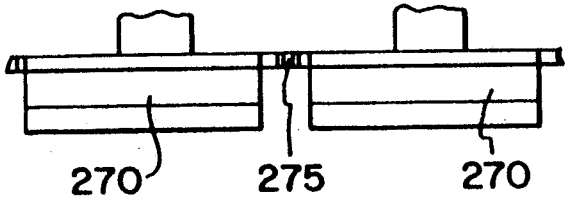

In a similar fashion, the skin flow control member 275 illustrated in FIGS. 8 and 9 also permits the spacing between adjacent guard bar segment 170 to increase or decrease during shaving. In this embodiment of the present invention, the base of the U-shaped skin flow control member 275 is disposed in the upper region of the space between guard bar segments 270.

What is claimed is:

1. A flexible guard bar for a flexible razor head, comprising:

a plurality of segments forwardly disposed for engagement with a skin surface being shaved, each of said segments comprising a forward skin engaging portion and a rearward portion, each of said segments being separated from adjacent segments, and having side walls thereby providing a space therebetween; and means for controlling skin flow through at least one space between at least one pair of said segments;

wherein said controlling means comprises a unitary web comprising a plurality of skin flow control means disposed along a plurality of said segments; and wherein said skin flow control means are substantially U-shaped and said web is disposed such that the base of said web is disposed forwardly of the point where said web contacts said side walls of said at least one pair of said segments.

2. The flexible guard bar of claim 1, wherein said web has a substantially fixed length.

3. A razor head comprising:

at least one blade having a sharpened edge;

a blade seat for supporting said blade;

a guard member comprising a plurality of segments disposed forwardly of said sharpened edge, each of said segments being separate from each adjacent segment thereby providing spaces therebetween;

means for attaching said guard bar segments to said blade seat; and means for controlling the flow of skin through said spaces between said segments;

wherein said segments comprise sidewalls and said controlling means comprises at least one web extending from sidewalls on adjacent segments;

wherein said web connects upper, rearward portions of said sidewalls;

wherein said web has a substantially fixed length; and wherein said web is substantially U-shaped.

4. The razor head of claim 3, wherein said web is disposed such that the base of said web is disposed forwardly of the point where the web contacts said side walls of said segments.

5. The razor head of claim 3, wherein said web is disposed such that the base of web is disposed above the point where the web contacts said side walls of said segments.

6. The razor head of claim 3, wherein said controlling means is sufficiently resilient to allow said spaces to change in response to forces exerted during shaving.

7. A razor head comprising:

a cap member;

at least one blade having a sharpened edge;

a blade seat for supporting said blade comprising a plurality of blade supports wherein adjacent blade supports are separated by a corrugation;

a guard member comprising a plurality of segments disposed forwardly of said sharpened edge, each of said segments comprising a forward, skin engaging portion and a rearward portion, each of said segments being separate from adjacent segments thereby providing a space therebetween;

means for attaching said guard bar segments to said blade seat; and means for controlling the flow of skin through at least one space between said segments;

wherein said segments comprise sidewalls and said controlling means comprises a web extending from said sidewalls on adjacent segments.

8. The razor head of claim 7, wherein said web connects upper, rearward portions of said sidewalls.

9. The razor head of claim 7, wherein said web is substantially U-shaped.

10. The razor head of claim 7, wherein said web is disposed such that the base of said web is disposed forwardly of the point where the web contacts said side walls of said segments.

11. The razor head of claim 7, wherein said web is disposed such that the base of said web is disposed above the point where the web contacts said side walls of said segments.

12. The razor head of claim 7, wherein said controlling means comprises a web with a fixed length.

* * * * *